United States Patent [19]

Browning

[11] Patent Number: 4,524,532

[45] Date of Patent: Jun. 25, 1985

[54] BOX BLADE WITH MOVABLE CLOSURE BLADE

[76] Inventor: James E. Browning, 10149 Hammerly, Ste. 167, Houston, Tex. 77080

[21] Appl. No.: 644,196

[22] Filed: Aug. 24, 1984

[51] Int. Cl.[3] ..... E02F 3/76

[52] U.S. Cl. ..... 37/117.5; 414/703; 414/704; 172/197; 172/199

[58] Field of Search ..... 37/117.5, 118, 126 R, 37/DIG. 3; 414/703, 704, 685; 172/145, 192, 196, 197, 199

[56] References Cited

U.S. PATENT DOCUMENTS

| | | | |
|---|---|---|---|
| 2,597,692 | 5/1952 | Wills et al. | 414/703 |
| 2,774,155 | 12/1956 | Hipp | 37/DIG. 3 |
| 2,839,851 | 6/1958 | Geiszler | 172/199 |
| 2,840,933 | 7/1958 | Brem | 37/117.5 |
| 3,209,475 | 10/1965 | Salna | 37/117.5 |
| 3,319,367 | 5/1967 | Lewis | 37/118 R |
| 3,430,703 | 3/1969 | Richey | 37/117.5 |
| 3,470,964 | 10/1969 | West et al. | 172/197 |
| 4,103,796 | 8/1978 | Hare | 414/703 |

FOREIGN PATENT DOCUMENTS

| | | | |
|---|---|---|---|
| 675827 | 12/1963 | Canada | 37/117.5 |

*Primary Examiner*—E. H. Eickholt

*Attorney, Agent, or Firm*—Neal J. Mosely

[57] ABSTRACT

A box blade assembly for attachment to earth moving vehicles has a rotatable semi-cylindrical closure blade. The box blade includes a pair of spaced parallel side walls, an open front, top, and bottom, and a rear wall having a depending scraper blade attached to the bottom edge thereof. A semi-cylindrical, transversely-extending, closure blade is rotatably mounted on the side walls of the box blade. A fluid-operated cylinder rotates the closure blade from an open position, with the bottom of the box blade open, to a closed position abutting the rear wall and scraper blade enclosing the bottom of the box blade. A vehicle pulls the box blade along the surface of the ground with the scraper blade scraping dirt and confining it within the side and rear walls. The closure blade when rotated to the closed position extends underneath the collected dirt so that it can be lifted with the box blade for transporting to another location. When the closure blade is rotated to the open position, the dirt is dumped from the bottom of the box blade.

15 Claims, 5 Drawing Figures

BOX BLADE WITH MOVABLE CLOSURE BLADE

BACKGROUND OF THE INVENTION

1. Field of the Invention

This invention relates generally to attachments for earth moving vehicles, such as tractors, and more particularly to a box blade attachment having a rotatable closure blade.

2. Brief Description of the Prior Art

Conventional box blade attachments for use on tractors consist basically of a rectangular frame enclosed on four sides and open at the top and bottom. A scraper blade extends along the bottom edge of the rear wall to scrape dirt into the frame as the tractor pulls the box blade along the surface of the ground. In addition to scraping operations, the dirt contained in the box blade may be leveled out to fill low spots as it passes over the surface of the ground.

The conventional box blade cannot be lifted for transporting dirt which has been collected because it has no bottom. To transfer dirt to another location, the tractor must drag the box blade filled with dirt along the surface of the ground to the other location, sometimes destroying everything in its path.

There are several patents which disclose various earth moving and transporting attachments for tractors, some of which are provided with closure means.

Rapp, U.S. Pat. No. 2,189,222 discloses a scraper bucket having an open rear end and a movable closure.

Bain, U.S. Pat. No. 2,558,531 discloses a scraper bucket having a retaining apron which can be moved to a position closing the scraper to form a bowl.

Lindquist, U.S. Pat. No. 2,565,384 discloses a scraper assembly having a power actuated scraper portion for moving earth into a supporting bucket.

Lewis, U.S. Pat. No. 3,319,367 discloses a bottom unloading scoop attachment for mounting on a tractor three point hitch.

Hare, U.S. Pat. No. 4,103,796 discloses an apparatus for attaching bucket or scoop onto a conventional three point hitch. The bucket is hydraulically actuated between a filling position and a dumping position.

The prior art in general, and none of these patents in particular, disclose an open bottom box blade having a rotatable closure blade for scraping and moving earth from one location to another.

SUMMARY OF THE INVENTION

It is therefore an object of the present invention to provide an improved multiple purpose box blade attachment for earth moving vehicles.

Another object of this invention is to provide a multipurpose box blade attachment to be operated by conventional earth moving vehicles.

Another object of this invention is to provide a box blade attachment which allows for removing earth from one area, containing and transporting the earth to another area and dumping earth from the box blade.

Another object of this invention is to provide a multipurpose box blade to maximize the effectiveness of scraping, grading, leveling, and earth moving operations.

Another object of this invention is to provide a multipurpose box blade attachment having parts which are easily replaced as they become worn or damaged.

Other objects of the invention will become apparent from time to time throughout the specification and claims as hereinafter related.

The above noted objects and other objects of the invention are accomplished by a box blade having a pair of spaced parallel side walls, an open front, top, and bottom, a rear wall having a depending scraper blade, and a semicylindrical closure blade mounted transversely between the side walls and hydraulically or pneumatically rotatable between an open position with the bottom of the box blade open and a closed position abutting the rear wall and enclosing the bottom of the box blade.

DESCRIPTION OF THE PREFERRED EMBODIMENT

Figure 1:
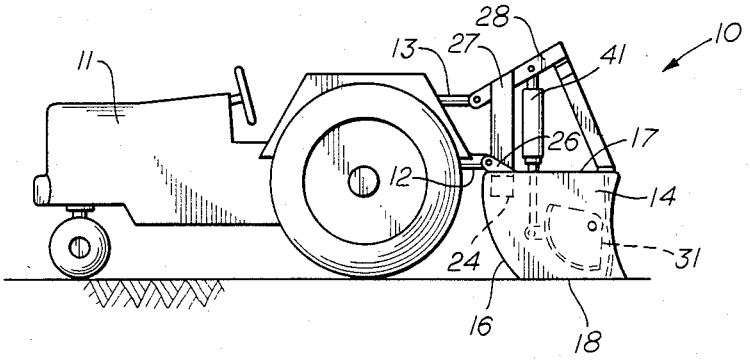
FIG. 1 is a view in side elevation of the box blade in accordance with the present invention attached to a conventional tractor.
Figure 2:
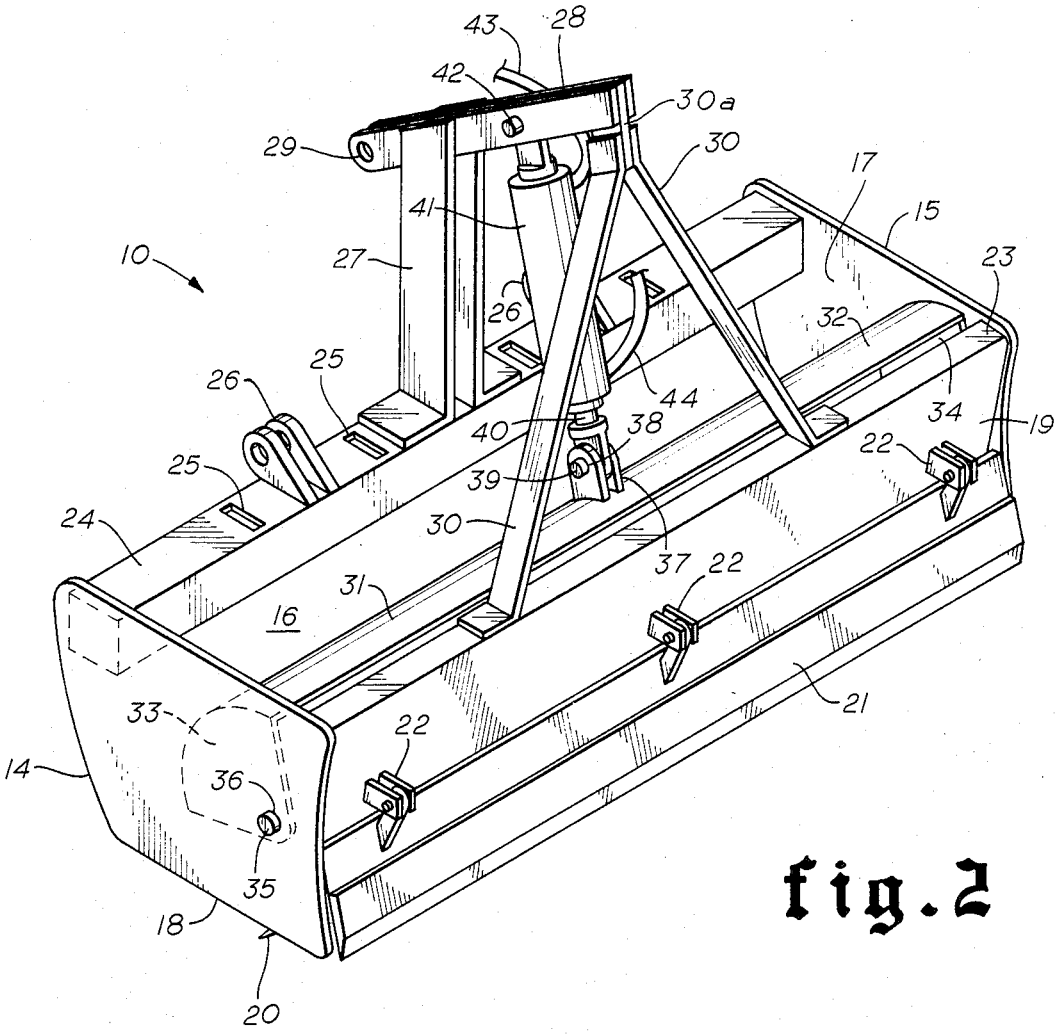
FIG. 2 is an isometric view of a preferred box blade having a rotatable closure blade.

Referring to the drawings by numerals of reference, there is shown a preferred embodiment of a box blade assembly 10 supported on a conventional farm tractor 11 by a typical hitch assembly including a pair of lower bars 12 and an upper connecting link 13. The box blade 10 comprises two spaced parallel side walls 14 and 15, an open front 16, an open top 17, an open bottom 18, and a rear wall 19. A scraper blade 20 is rigidly attached to the bottom edge of rear wall 19 extending downwardly and inwardly therefrom to a point below the bottom edges of the side walls 14 and 15.

A trailing back fill blade 21 is pivotally attached to the rear wall 19 by means of hinges 22 and extends downwardly and outwardly therefrom to ride over the surface of the ground. During forward scraping operations, the trailing blade 21 is free to pivot upwardly, and its weight aids in leveling operations. During backward movement, the back fill blade 21 supported by the back wall 19 may be used for scraping, leveling, and back fill operations.

The rear wall 19 has a flat horizontal top flange 23 extending transversely between side walls 14 and 15 near the top of the open front end 16. A beam 24 extends transversely between the side walls 14 and 15 near the open front end 16. The beam 24 may be provided with slots 25 to removably receive conventional scarifyiny teeth (not shown). The beam 24 serves as a principal support member and its weight holds the box blade 10 in firm contact with the ground.

A pair of ears 26 welded on the upper surface of the beam 24 connect the box blade 10 to the lower hitch bars 12 of the tractor 11. A pair of opposed, generally L-shaped flat rectangular brackets 27 are welded to the top surface of the beam 24 and extend upwardly therefrom. A pair of flat rectangular bars 28 are welded between the top ends of the bracket members 27 and extend angularly rearward and forward therefrom. The rearwardly extended end has an opening 29 there-through for connection of the box blade 10 to the upper connecting link 13 of the tractor 11.

A pair of opposed converging, elongated brackets 30 are welded on the horizontal top portion of the 23 of the rear wall 19. The top ends of the brackets 30 are secured to a plate shaped link 30*a*, as by welding. Link 30*a* is rigidly secured, as by welding, between the forwardly extended ends of the bars 28.

A semi-cylindrical closure blade 31 comprises a curved wall 32 with two generally pie-shaped arcuate side walls 33 and 34 welded thereon, and is mounted between side walls 14 and 15 of the box blade 10. A pair of pivot pins 35 fit in axially aligned holes 36 in the side walls 14 and 15 and are releasably attached by conventional means such as threads to the arcuate side walls 33 and 34 near their apex portions.

A pair of outwardly extending ears 37 are welded to the upper portion of curved wall 32 and have holes 38 receiving a pivot pin 39 for releasably connecting blade 31 to the outer end of a piston rod 40 of hydraulic cylinder 41. The opposite end of the cylinder 41 is releasably connected between the bars 28 by pivot pin 42. In this manner, cylinder 41 is pivotally and releasably connected between the bars 28 and the closure blade 31. Hoses 43 and 44 (partially shown) extend from the cylinder 41 an existing hydraulic fluid source (not shown) on the tractor 11.

Figure 5:
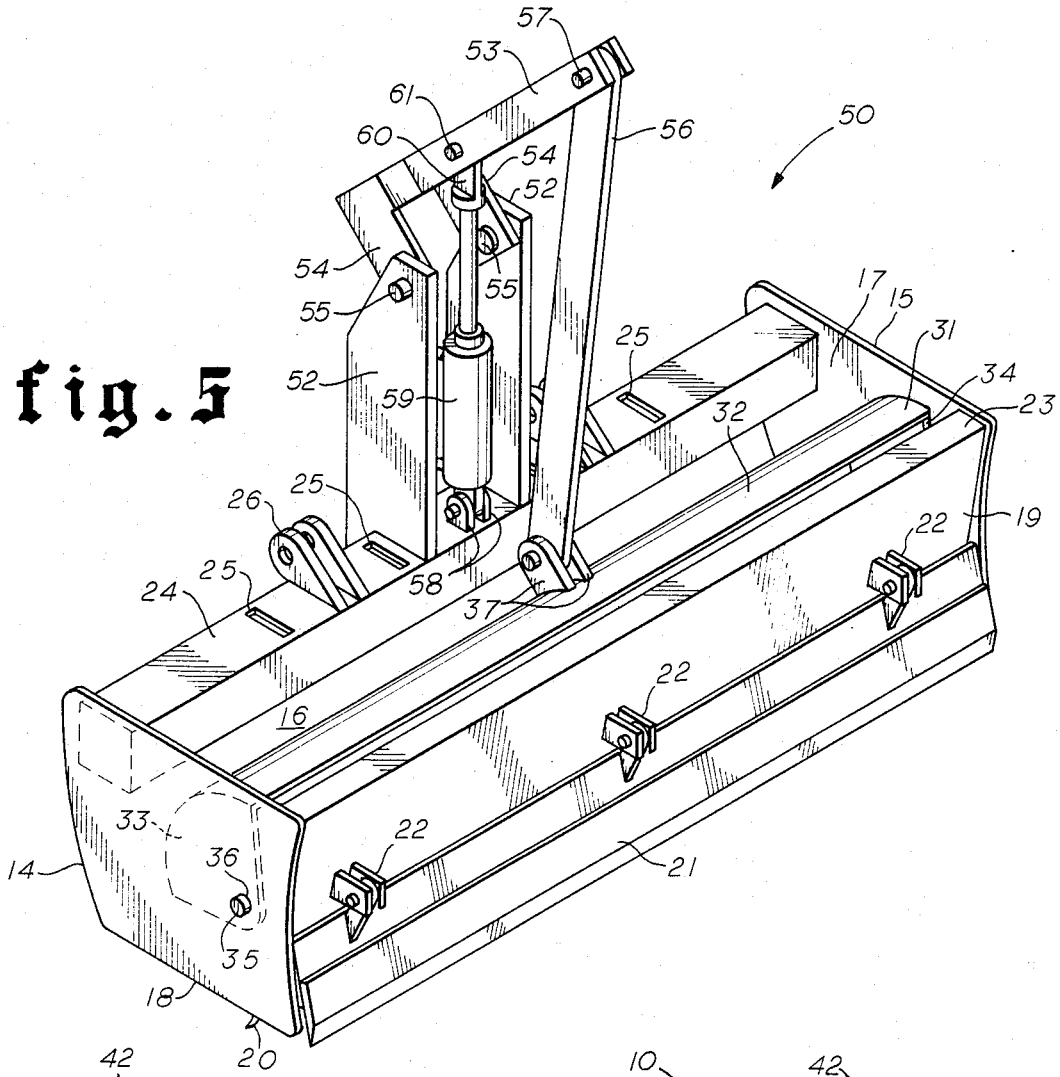
FIG. 5 is an isometric view of an alternate embodiment of the box blade with a different actuating mechanism.

FIG. 5 shows a box blade 50 having a modified actuating assembly 51. In this embodiment, a pair of spaced flat rectangular plates 52 are welded to the top surface of the beam 24 and extend upwardly therefrom. A yoke member 53 having a pair of downwardly extending lugs 54 at its rearward end is pivotally connected between the plates 52 by pivot pins 55. The forward end of the yoke 53 extends outwardly from the plates 52 and receives the top end of a flat drive link 56. A pivot pin 57 pivotally connects top end of link 56 to the forward end of yoke 53 and the bottom end of link 56 extends downwardly and is received in the outwardly extended ears 37 on the curved wall 32 of the closure blade 31. A pair of ears 58 welded on the top surface of the beam 24, between the plates 52, receive one end of a hydraulic cylinder 59. The outer end of the piston rod 60 of the cylinder 59 is pivotally connected to the yoke 53 by pivot pin 61. In this manner, when the cylinder 59 is actuated, the yoke 53 pivots about the pin 55 and carries the bar 56 with it to rotate the closure blade 31. The portions of this embodiment which are the same as in the embodiment of FIGS. 1–4 are given the same reference numerals and have the same function.

OPERATION

Figure 3:
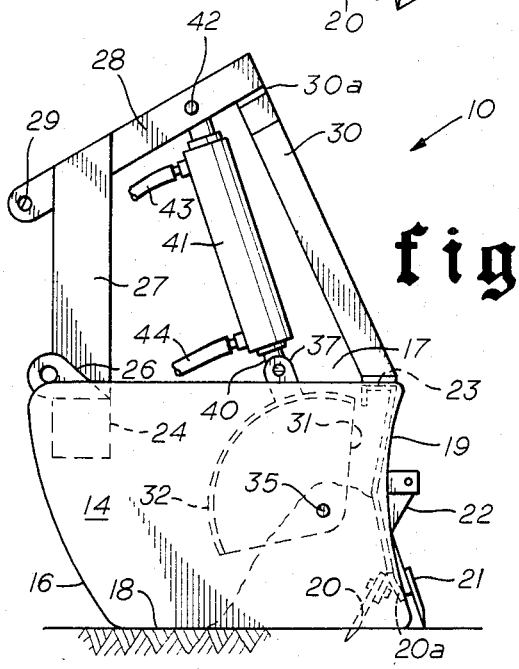
FIG. 3 is a view in side elevation of the box blade with the closure blade in the open position.
Figure 4:
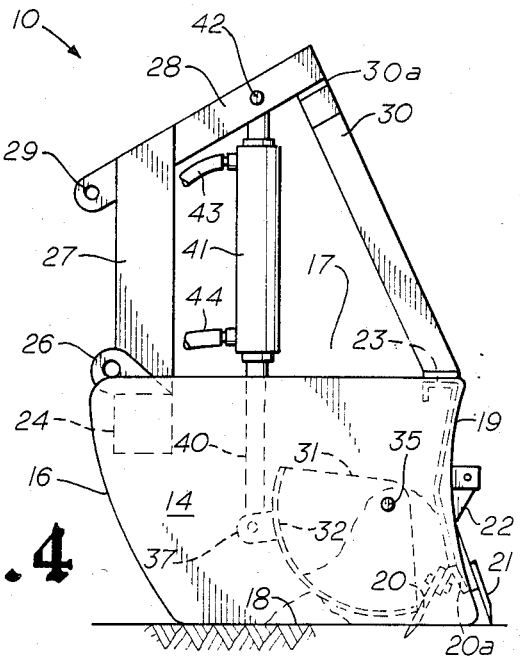
FIG. 4 is a view in side elevation of the box blade with the closure blade in the closed position.

Referring now to FIGS. 3 and 4, the operation of the box blade 10 will be explained. With the hoses 43 and 44 connected to the fluid source of the tractor 11, and the box blade connected by the ears 26 to the lower bars 12 and by the bar 28 to the connecting link 13 of the vehicle, the box blade may be controlled by the operator to assume a variety of operational positions. Actuation of the existing conventional hitch connecting link 13 and lower bars 12 allows the box blade 10 to be raised and to pivot about the connection of the lower bars 12. Actuation of the cylinder 41 causes rotation of the closure blade 31.

As the vehicle 11 pulls the box blade 10 along the surface of the ground, the earth is dislodged by the scraper digging into the surface and fills the confines of the box blade frame. When the cylinder 41 is actuated to rotate the closure blade to the open position as shown in FIG. 3, the box blade 10 may be slightly raised or pivoted to distribute the collected earth along the ground by allowing it to pass beneath the rear wall 19 and scraper blade 20. The trailing pivotally mounted back fill blade serves to evenly distribute and level the earth as it passes over low spots in the ground surface.

When it is desirable to transfer dirt from one area to another, the cylinder 41 is actuated to rotate the closure blade 31 to the closed position abutting the back wall 19 and scraper blade 20 (FIG. 4). In this position, the curved wall 32 of the closure blade 31 extends beneath the collected earth. The box blade 10 with the closure blade 31 in the closed position may then be lifted by actuation of the conventional hitch mechanism. The box blade assembly can also be operated with the closure blade 31 partially closed so that the scraped dirt will tend to collect on top of the closure blade. The closure blade is then fully closed when filled with dirt to be lifted and moved.

The vehicle 11 can then transport the collected earth to another location. The cylinder 41 may again be actuated to rotate the closure blade 31 to the open position dumping the collected earth through the open bottom 18. Alternatively, the box blade 10 may be first lowered to the ground and then the closure blade 31 rotated to the open position whereby the earth is still confined within the box blade frame, but the bottom 18 is now open and box blade 10 is ready for spreading and leveling operations at the new location. The operation of the embodiment of FIG. 5 is the same except that a different actuating mechanism is used.

It should be obvious to those skilled in the art that the apparatus is adaptable to various earth moving vehicles, and the cylinders herein described may be either hydraulically or pneumatically operated depending upon the particular system utilized by the vehicle. The closure blade may have other configurations than cylindrical, e.g. flat, square, angular, etc. The operation may also be manual as well as powered.

While this invention has been described fully and completely with special emphasis upon a preferred embodiment, it should be understood that within the scope of the appended claims the invention may be practiced otherwise than as specifically described herein.

I claim:

1. A box blade assembly for attachment to earth-moving vehicles comprising:

a box blade frame having two spaced parallel side walls, an open top and bottom, an open front end, a horizontal crossbeam extending transversely between said side walls near said open top and front ends, and a rear wall extending transversely between said side walls, the bottom edge of said rear wall terminating above the bottom edge of said side walls, an inwardly facing scraper member secured on said box blade rear wall and extending below the bottom edge of said side walls, and a trailing back fill member pivotally mounted on and carried by said rear wall, a closure member extending transversely between said side walls and movably supported thereon and movable between an open position substantially exposing said open bottom and a closed position substantially enclosing said open bottom, and means supported on said box blade frame and operatively connected to said closure member to move the same between said open and said closed positions.

2. A box blade assembly according to claim 1 in which said closure member comprises a semi-cylindrical member mounted for rotational movement between the side walls of said box blade frame.

3. A box blade assembly according to claim 1 in which said means for moving said closure member comprises fluid-actuated means.

4. A box blade assembly according to claim 1 in which said closure member comprises a semi-cylindrical member mounted for rotational movement between the side walls of said box blade frame, and said means for moving said closure member comprises fluid-actuated means.

5. A box blade assembly according to claim 1 in which said means for moving said closure member comprises at least one hydraulic cylinder.

6. A box blade assembly according to claim 1 in which said means for moving said closure member comprises at least one pneumatic cylinder.

7. A box blade assembly according to claim 1 in which said closure member comprises a semi-cylindrical member mounted for rotational movement between the side walls of said box blade frame, and said means for moving said closure member comprises at least one hydraulic cylinder.

8. A box blade assembly according to claim 1 in which said closure member comprises a semi-cylindrical member mounted for rotational movement between the side walls of said box blade frame, and said means for moving said closure member comprises at least one pneumatic cylinder.

9. A box blade assembly according to claim 1 in which said horizontal crossbeam of said box blade frame has a plurality of slots adapted to receive and carry scarifying members.

10. A box blade assembly according to claim 1 in which said closure blade comprises two opposing spaced parallel side walls of flat arcuate configuration, and a semi-cylindrical wall secured to the curved portion of said side walls and extending transversely therebetween, one longitudinal edge of said closure blade abutting an upper portion of said rear wall of said box blade frame in the open position and another longitudinal edge of said closure blade abutting a lower portion of said rear wall in the closed position.

11. A box blade assembly according to claim 1 in which said closure member comprises a semi-cylindrical wall member mounted for rotational movement between the side walls of said box blade frame and having a connector member in the semi-cylindrical wall thereof, said box blade frame including a supporting frame extending from the top portion thereof, and said means for moving said closure member comprises a fluid-actuated cylinder and operating piston connected one to said connector member and the other to said supporting frame on said box blade frame.

12. A box blade assembly according to claim 1 in which said closure member comprises a semi-cylindrical wall member mounted for rotational movement between the side walls of said box blade frame and having a connector member in the semi-cylindrical wall thereof, said box blade frame including a supporting frame extending from the top portion thereof, an operating lever member pivotally supported on said supporting frame and having an operating end connected to said connector member, and said means for moving said closure member comprises a fluid-actuated cylinder and operating piston connected one to said box blade frame and the other to said supporting frame.

13. A box blade assembly according to claim 1 in which said closure member is moved manually.

14. A box blade assembly for attachment to earth-moving vehicles comprising;

a box blade frame having two spaced parallel side walls, an open top and bottom, an open front end, a horizontal crossbeam extending transversely between said side walls near said open top and front ends, and a rear wall extending transversely between said side walls, the bottom edge of said rear wall terminating above the bottom edge of said side walls, an inwardly facing scraper member secured on said box blade rear wall and extending below the bottom edge of said side walls, and a trailing back fill member pivotally mounted on and carried by said rear wall, a closure member extending transversely between said side walls and movably supported thereon and movable between an open position substantially exposing said open bottom and a closed position substantially enclosing said open bottom, said closure blade comprising two spaced parallel side walls of flat arcuate configuration, a semi-cylindrical wall secured to the curved portion of said side walls and extending transversely therebetween and having a connector member in the semi-cylindrical wall thereof, and one longitudinal edge of said closure blade abutting an upper portion of said rear wall of said box blade frame in the open position and another longitudinal edge of said closure blade abutting a lower portion of said rear wall in the closed position, said box blade frame including a supporting frame extending from the top portion thereof, and means for moving said closure member between an open and a closed position comprising a fluid-actuated cylinder and operating piston connected one to said connector member and the other to said supporting frame on said box blade frame.

15. A box blade assembly for attachment to earth-moving vehicles comprising;

a box blade frame having two spaced parallel side walls, an open top and bottom, an open front end, a horizontal crossbeam extending transversely between said side walls near said open top and front ends, and a rear wall extending transversely between said side walls, the bottom edge of said rear wall terminating above the bottom edge of said side walls, an inwardly facing scraper member secured on said box blade rear wall and extending below the bottom edge of said side walls, and a trailing back fill member pivotally mounted on and carried by said rear wall, a closure member extending transversely between said side walls and movably supported thereon and movable between an open position substantially exposing said open bottom and a closed position substantially enclosing said open bottom, said closure blade comprising two spaced parallel side walls of flat arcuate configuration, a semi-cylindrical wall secured to the curved portion of said side walls and extending transversely therebetween and having a connector member in the semi-cylindrical wall thereof, and one longitudinal edge of said closure blade abutting an upper portion of said rear wall of said box blade frame in the open position and another longitudinal edge of said closure blade abutting a lower portion of said rear wall in the closed position, said box blade frame including a supporting frame extending from the top portion thereof, an operating lever member pivotally supported on said supporting frame and having an operating end connected to said connector member, and means for moving said closure member between an open and a closed position comprising a fluid-actuated cylinder and operating piston connected one to said box blade frame and the other to said supporting frame.

* * * * *